US007617927B1

(12) United States Patent
Smith, Jr.

(10) Patent No.: US 7,617,927 B1
(45) Date of Patent: Nov. 17, 2009

(54) COLLAPSIBLE TOOTHBRUSH HOLDER

(76) Inventor: Elliott Smith, Jr., 7715 Brighton Ave., Los Angeles, CA (US) 90047

( * ) Notice: Subject to any disclaimer, the term of this patent is extended or adjusted under 35 U.S.C. 154(b) by 512 days.

(21) Appl. No.: 11/517,049

(22) Filed: Sep. 7, 2006

Related U.S. Application Data

(60) Provisional application No. 60/714,908, filed on Sep. 8, 2005.

(51) Int. Cl.
*A47K 1/09* (2006.01)
*A45D 44/18* (2006.01)

(52) U.S. Cl. ..... 206/15.3; 206/362; 220/8

(58) Field of Classification Search ..... 206/15.2, 206/15.3, 209, 361, 362, 362.1, 362.2, 362.3, 206/349, 218, 214; 211/65, 66; 250/455.11; 220/8, 4.26, 4.27, 4.28; D7/512; 215/6; 446/310

See application file for complete search history.

(56) References Cited

U.S. PATENT DOCUMENTS 4,116,329 A * 9/1978 Garden ..... 206/1.5
4,158,413 A 6/1979 Briggs
4,927,011 A 5/1990 Wilkinson
5,517,712 A 5/1996 Schiano
5,522,497 A * 6/1996 Stacy ..... 206/209.1
6,666,329 B1 * 12/2003 Charbonneau ..... 206/218
2004/0232016 A1 * 11/2004 Dietrich ..... 206/315.3

* cited by examiner

*Primary Examiner*—Mickey Yu
*Assistant Examiner*—Steven A. Reynolds

(57) ABSTRACT

A holder includes top, middle, and bottom sections respectively. The middle section includes hollow cylinders connected to the top and bottom sections respectively. The cylinders extend along a vertical axis and have a vertical wall oriented thereabout. The top, middle and bottom sections form a hollow chamber. The top section has a bottom end connected to an upper end of the middle section and a top surface provided with a plurality of apertures. An outer wall is formed with the bottom end and the top surface respectively. The bottom section is mated to a lower end of the middle section and includes a plurality of apertures therein, and has a diameter greater than a diameter of the lower end of the middle section. A mechanism for telescopically adjusting the top and middle sections is spaced from the bottom section and anchored to a bottom one of the cylinders.

15 Claims, 5 Drawing Sheets

COLLAPSIBLE TOOTHBRUSH HOLDER

CROSS REFERENCE TO RELATED APPLICATIONS

This application claims the benefit of U.S. Provisional Application No. 60/714,908, filed Sep. 8, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to toothbrush holders and, more particularly, to a collapsible toothbrush holder to provide travelers with an effective and hygienic means of toothbrush storage while traveling.

2. Prior Art

Most bathrooms in hospitals, hotels and motels do not contain toothbrush holders for patients or patrons although various types of wall mounted toothbrush holders are known. In order to isolate the toothbrush with a high degree of separation from a sink surface, apparatuses such as wall mounted shelves with groove shaped passage holes therein for insertion of the toothbrush handles therein are provided. The toothbrushes are held in place because the width of the bristle portion of a toothbrush is wider than the diameter of the hole for the handle, so that the toothbrush bristles rest upon the wall mounted shelf. However, in the toothbrushes mounted by these shelf apparatuses, it is difficult to isolate the bristles from the shelf which contains water, particles or contaminated products therein. Moreover, often it is difficult to mount the shelves to a wall by persons with limited mechanical abilities or arthritic hand conditions.

One prior art example shows a storage system for personal care products used for dental hygiene and oral care. The device has a storage tube with an interior and exterior surface and two ends, one end closed and used as the base and the other end open. A toothbrush ring with outer and inner rims is mounted on the open end of the storage tube, the outer rim of toothbrush ring extends beyond the exterior surface of the storage tube and contains a plurality of apertures in which toothbrushes hang and the inner rim extends inside the interior surface of the storage tube.

Inserted in the storage tube is a rinse cup with an exterior flange on the open end which catches the interior rim of the toothbrush ring. The rinse cup lid rests on the inner rim of the toothbrush ring covering the exterior flange of the rinse cup. Alternatively, the rinse cup lid is removably connected to the exterior rim of the toothbrush ring. An optional wall bracket can be used to mount the storage system on the wall. Unfortunately, this prior art example allows the bristles of the toothbrush to contact a surface upon which it rests, thus creating a storage solution that is not hygienic. In addition, this example does not provide a means for containing fluid dripping from the bottom of the toothbrush during storage.

Another prior art example shows a portable oral hygiene tool that includes an ergonomically formed toothbrush for comfort, control and ease of use, encompassing a toothbrush body having a bristle head portion to accommodate changeable and renewable bristles to be discarded when they are past their time of effectiveness and to maintain the toothbrush sanitarily and hygienically. It also accommodates various sized bristles and firmness. Unfortunately, this prior art example requires a specially formed toothbrush to fit into the holder. This example also does not provide a means for containing fluid dripping from the toothbrush during storage.

Accordingly, a need remains for a collapsible toothbrush holder in order to overcome the above-noted shortcomings. The present invention satisfies such a need by providing an apparatus that is simple and easy to use, lightweight yet durable in design, and provides travelers with an efficient and hygienic means of toothbrush storage while traveling. Such an apparatus effectively eliminates the need to leave used toothbrushes lying on bathroom counters, thus allowing a user to advantageously keep toothbrushes clean and sanitary. The apparatus is conveniently collapsible, space-saving, and easily packed into a travel bag. The inexpensive apparatus is ideal for travelers and students.

BRIEF SUMMARY OF THE INVENTION

In view of the foregoing background, it is therefore an object of the present invention to provide an apparatus for a collapsible toothbrush holder. These and other objects, features, and advantages of the invention are provided by a collapsible toothbrush holder for effectively and hygienically storing a plurality of toothbrushes while traveling.

The apparatus includes a resiliently squeezable body that has telescopically conjoined top, middle, and bottom sections respectively. Such a middle section conveniently includes a plurality of concentrically formed hollow cylinders effectively interfitted within each other and advantageously connected to the top and bottom sections respectively. Such cylinders are telescopically extendable along a centrally registered vertical axis passing through the body and have a vertical wall oriented thereabout. Such top, middle and bottom sections effectively form a collapsible hollow chamber therein for housing corresponding handles of the toothbrushes. Such a hollow chamber expands downwardly along the vertical axis.

The cylinders preferably have decreasing diameters such that a top one of the cylinders is slidably positional within an adjacently disposed lower one of the cylinders when the middle section is collapsed. Each of such cylinders also preferably includes a top flange portion and a pair of bottom flange portions monolithically formed with a vertically registered side of the cylinder. Each of such top and pair of bottom flange portions is advantageously registered orthogonal to the side. The top flange portion and one of the pair of bottom flange portions effectively extend inwardly toward the vertical axis. Another of the pair of bottom flange portions effectively extends outwardly from the side and is oppositely faced from the one bottom flange portion. Such another bottom flange portion has a top shoulder conveniently seated directly below the top flange portion and terminating at the side of the bottom cylinder such that the bottom cylinder is effectively prohibited from vertically displacing beyond the top shoulder.

Such a top section has an annular bottom end directly connected to an upper end of the middle section. The top section further has a planar top surface conveniently provided with a plurality of apertures formed therein such that the handles of the toothbrushes vertically penetrate through the apertures and contiguously lay within the chamber. Such apertures are equidistantly spaced from each other and advantageously oriented concentrically about the vertical axis such that the tooth brushes effectively maintain fixed spatial relationships during stored conditions. The top section further includes an outer wall monolithically formed with the bottom end and the top surface respectively. Such an outer wall preferably includes a flange portion monolithically formed with the bottom end thereof and directly engaged with an associated one of the top flange portions. The top section is statically coupled directly to the middle section when the bottom section is selectively removed from the middle section.

Such a bottom section has an annular shape threadably mated to a lower end of the middle section. The bottom section is conveniently provided with a plurality of apertures formed therein such that fluid advantageously drains from the toothbrushes housed within the chamber and effectively penetrates outwardly from the body. Such apertures radially extend outwardly from a center of the bottom section. The bottom section advantageously has a diameter greater than a diameter of the lower end of the middle section such that the bottom section conveniently provides a stable platform during operating conditions.

The apparatus further includes a mechanism for telescopically adjusting the top and middle sections in such a manner that the bottom section advantageously remains stationary as a longitudinal length of the chamber is adjusted. Such a telescopic adjusting mechanism is effectively spaced from the bottom section and anchored to a bottom one of the cylinders. The telescopically adjusting mechanism further includes a plurality of deformably resilient helical springs vertically oriented within the chamber and positioned adjacent to an inner perimeter of the cylinders respectively. Such selected ones of the springs has a top end directly anchored to a bottom surface of the pair of bottom flange portions respectively. Such other ones of the springs further have a bottom end directly anchored to corresponding ones of the pair of bottom flanges. The springs are compressed and decompressed when the middle section is collapsed and extended respectively. The springs effectively maintain the middle section in a statically and vertically extended position during operating conditions.

Each of the outer walls and the sides conveniently include a notch formed therein and advantageously positioned above corresponding ones of the pair of bottom flange portions such that the top flange portions effectively become interfitted with the notches respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
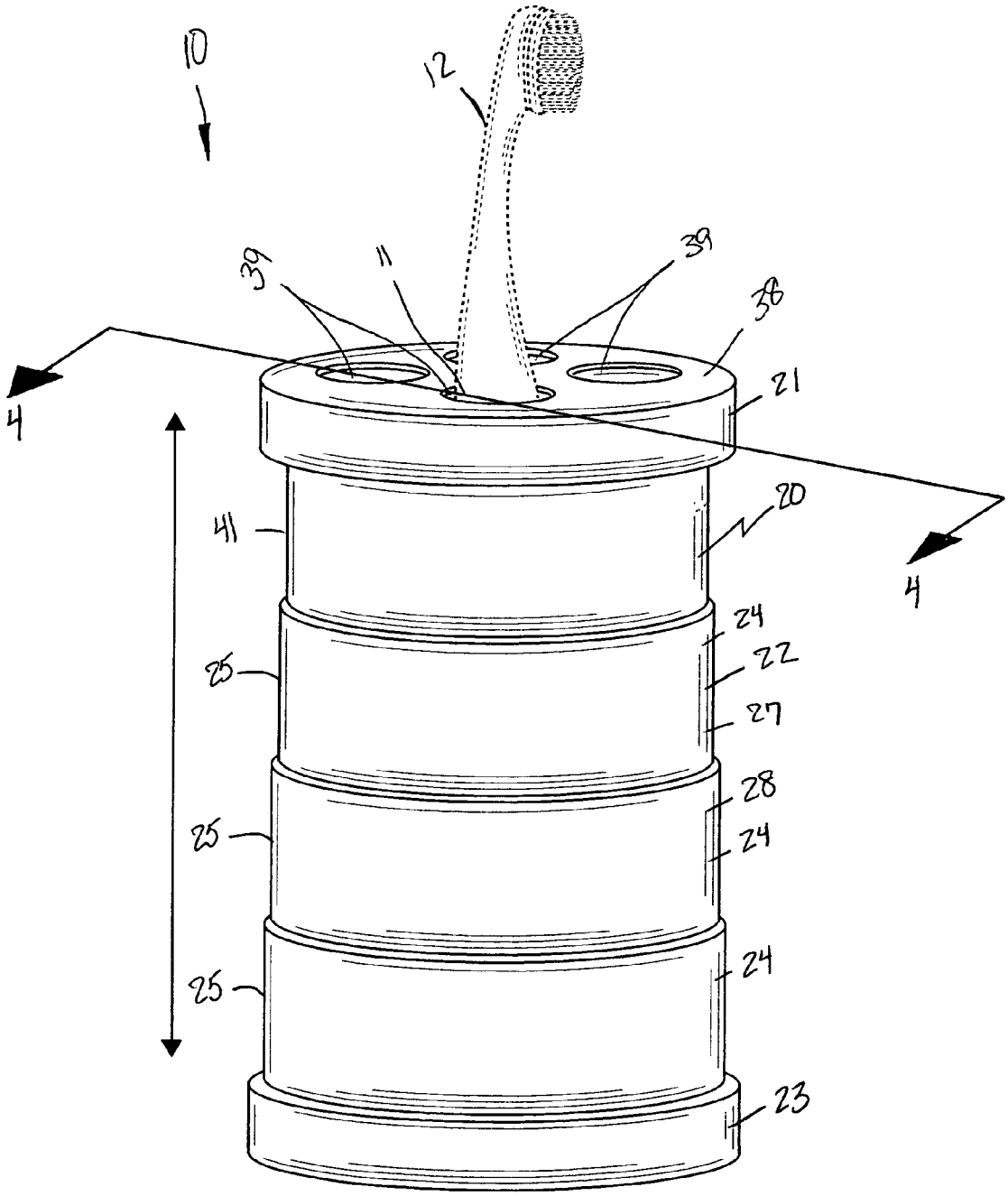
FIG. 1 is a perspective view of a collapsible toothbrush holder showing the apparatus in an extended position, in accordance with the present invention.
Figure 2:
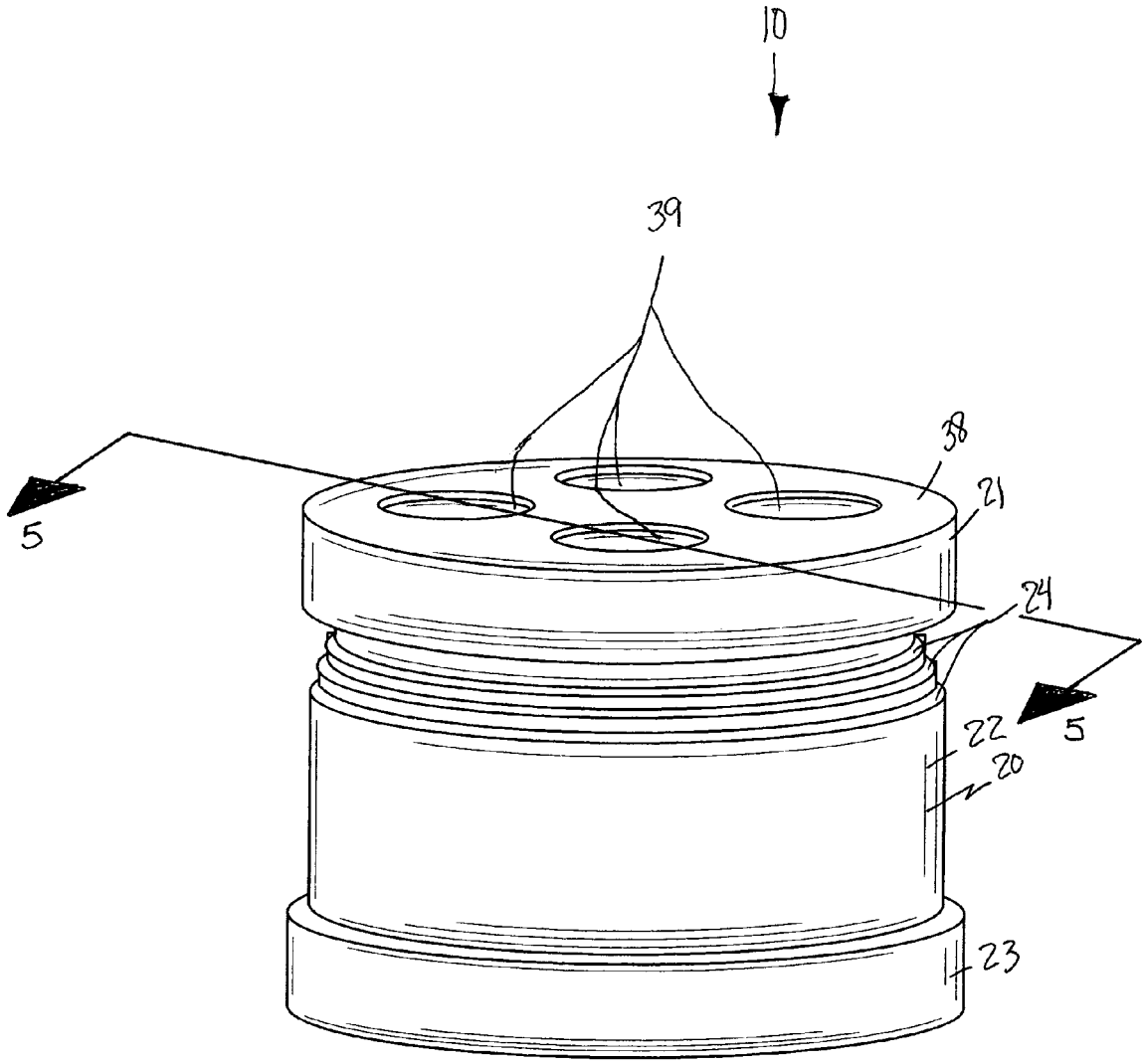
FIG. 2 is a perspective view of the apparatus shown in FIG. 1 showing the apparatus in a collapsed position.
Figure 3:
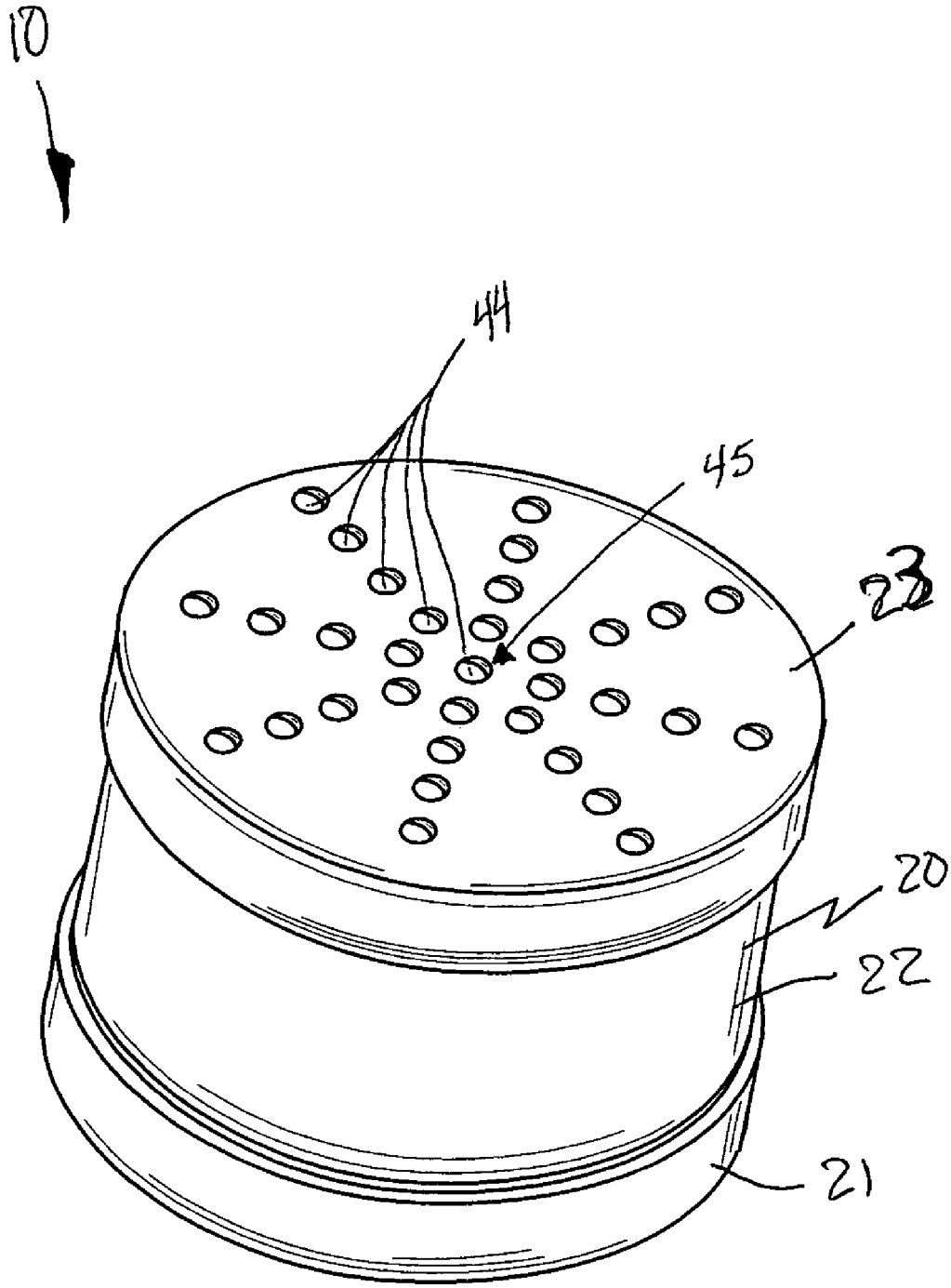
FIG. 3 is a perspective view of the apparatus shown in FIG. 2 showing the bottom section.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a collapsible toothbrush holder. It should be understood that the apparatus 10 may be used to hold many different types of dental implements and should not be limited in use to holding only toothbrushes.

Referring initially to FIGS. 1, 2, 3, 4 and 5, the apparatus 10 includes a resiliently squeezable body 20 that has telescopically conjoined top 21, middle 22, and bottom 23 sections respectively. Of course, such a body 20 can be produced from a variety of suitable resiliently squeezable materials, as is obvious to a person of ordinary skill in the art. Such a middle section 22 conveniently includes a plurality of concentrically formed hollow cylinders 24 effectively interfitted within each other and advantageously connected to the top 21 and bottom 22 sections respectively, which is crucial for allowing the apparatus 10 to be collapsed and stored when not in use. Such cylinders 24 are telescopically extendable along a centrally registered vertical axis passing through the body 20 and have a vertical wall 25 oriented thereabout. Such top 21, middle 22 and bottom 23 sections effectively form a collapsible hollow chamber 26 therein for housing corresponding handles 11 of the toothbrushes 12. Such a hollow chamber 26 expands downwardly along the vertical axis.

Referring to FIGS. 1, 2, 4 and 5, the cylinders 24 preferably have decreasing diameters such that a top one 27 of the cylinders 24 is slidably positional within an adjacently disposed lower one 28 of the cylinders 24 when the middle section 22 is collapsed. Each of such cylinders 24 also preferably includes a top flange portion 29 and a pair of bottom flange portions 31 monolithically formed with a vertically registered side 32 of the cylinder 24. Each of such top 29 and pair of bottom 31 flange portions is advantageously registered orthogonal to the side 32. The top flange portion 29 and one 33 of the pair 31 of bottom flange portions effectively extend inwardly toward the vertical axis.

Another 34 of the pair 31 of bottom flange portions effectively extends outwardly from the side 32 and is oppositely faced from the one bottom flange portion 33. Such another bottom flange portion 34 has a top shoulder 35 conveniently seated directly below the top flange portion 29, without the use of intervening elements, and terminating at the side 32 of the lower cylinder 28 such that the lower cylinder 28 is effectively prohibited from vertically displacing beyond the top shoulder 35. Of course, each of such cylinders 24 has the above described relationship, as is obvious to a person of ordinary skill in the art.

Figure 4:
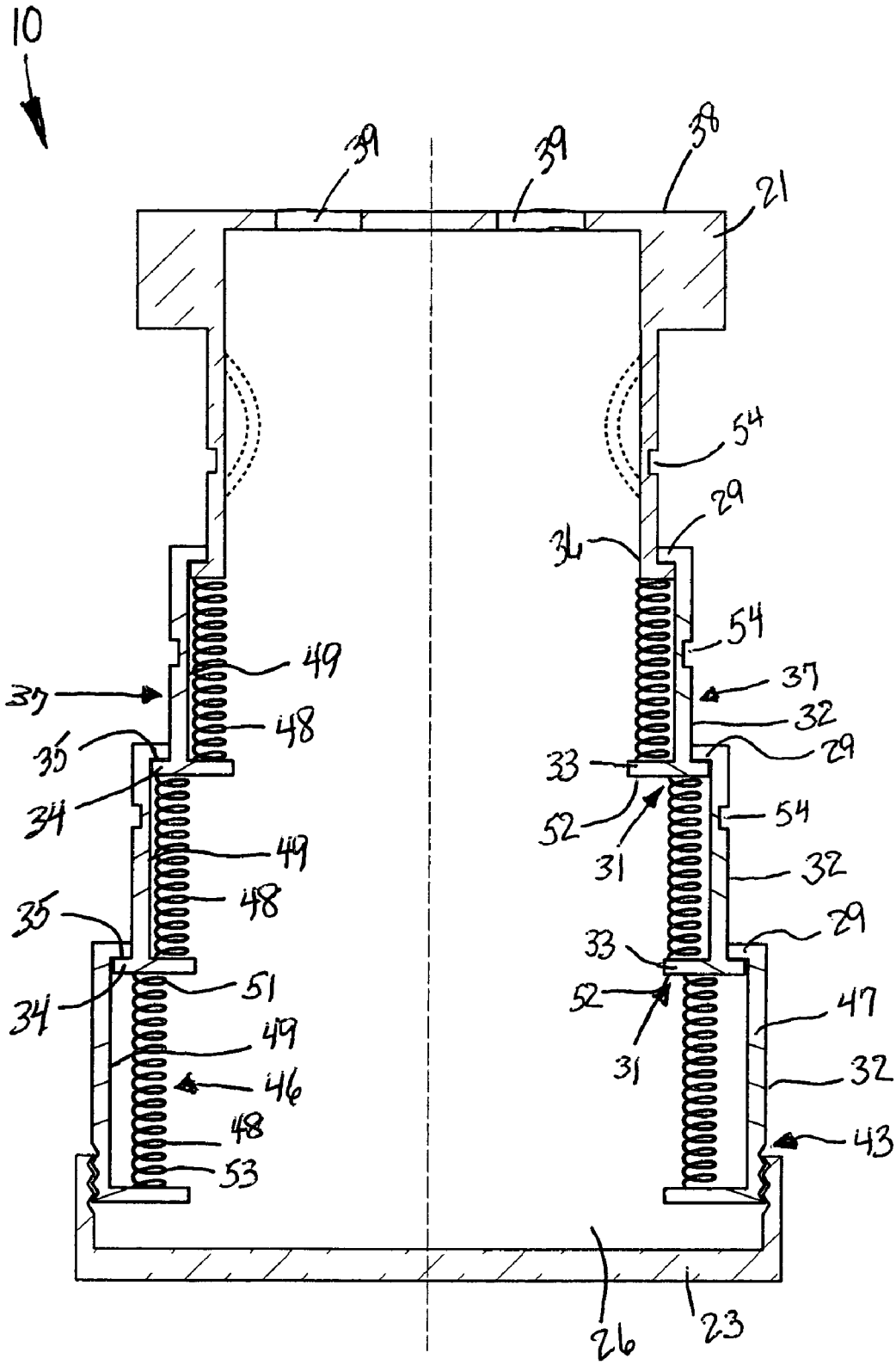
FIG. 4 is a cross-sectional view of the apparatus shown in FIG. 1 taken along line 4-4.
Figure 5:
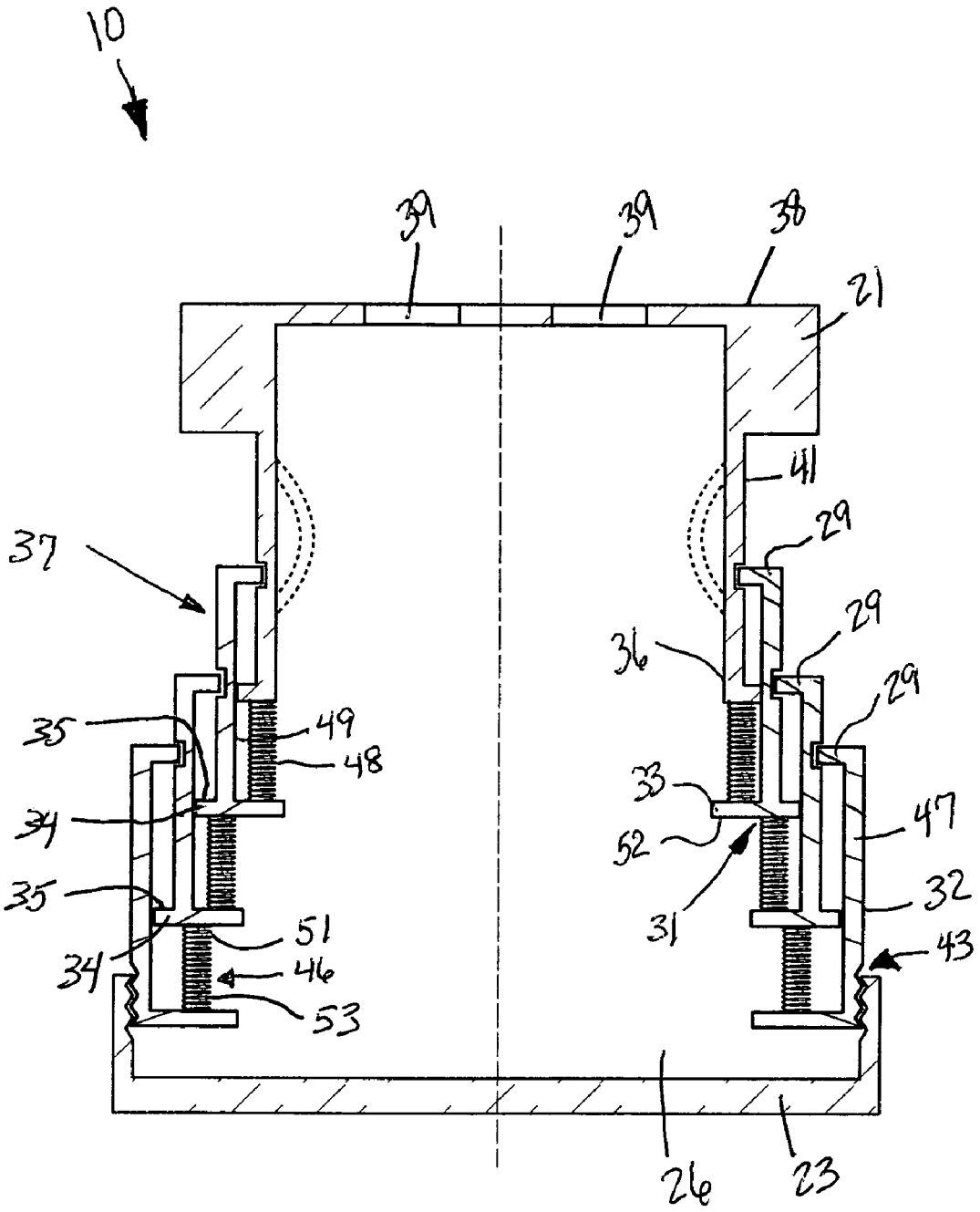
FIG. 5 is a cross-sectional view of the apparatus shown in FIG. 2 taken along line 2-2.

Referring to FIGS. 1, 4 and 5, such a top section 21 has an annular bottom end 36 directly connected to an upper end 37 of the middle section 22, without the use of intervening elements. The top section 21 further has a planar top surface 38 conveniently provided with a plurality of apertures 39 formed therein, which is essential such that the handles 11 of the toothbrushes 12 vertically penetrate through the apertures 39 and contiguously lay within the chamber 26. Such apertures 39 are equidistantly spaced from each other and advantageously oriented concentrically about the vertical axis, which is critical such that the toothbrushes 12 effectively maintain fixed spatial relationships during stored conditions. Such a relationship effectively creates a sanitary and hygienic storage condition. Of course, such a plurality of apertures 39 can be formed in a variety of shapes and sizes, as is obvious to a person of ordinary skill in the art.

Again referring to FIGS. 1, 4 and 5, the top section 21 further includes an outer wall 41 monolithically formed with the bottom end 36 and the top surface 38 respectively. Such an outer wall 41 preferably includes a flange portion 42 monolithically formed with the bottom end 36 thereof and directly engaged, without the use of intervening elements, with an associated one of the top flange 29 portions. The top section 21 is statically coupled directly to the middle section 22 when the bottom section 23 is selectively removed from the middle section 22, which is advantageous such that the top section 21 does not become prematurely disengaged from the middle section 22 when the bottom section 23 is removed.

Again referring to FIGS. 1 through 5, such a bottom section 23 has an annular shape threadably mated to a lower end 43 of the middle section 22, which is important for selectively removing the bottom section 23 from the middle section 22 according to the desire of a user. The bottom section 23 is conveniently provided with a plurality of apertures 44 formed therein such that fluid advantageously drains from the toothbrushes 12 housed within the chamber 26 and effectively penetrates outwardly from the body 20. Such apertures 44 radially extend outwardly from a center 45 of the bottom section 23. Of course, such a plurality of apertures 44 can be formed in a variety of shapes and sizes, as is obvious to a person of ordinary skill in the art. The bottom section 23 advantageously has a diameter greater than a diameter of the lower end 43 of the middle section 22, which is vital such that the bottom section 23 conveniently provides a stable platform during operating conditions. Of course, such a bottom section 23 can be formed in a variety of sizes, as is obvious to a person of ordinary skill in the art.

Referring to FIGS. 4 and 5, the apparatus 10 further includes a mechanism 46 for telescopically adjusting the top 21 and middle 22 sections in such a manner that the bottom section 23 advantageously remains stationary as a longitudinal length of the chamber 26 is adjusted. Such a telescopic adjusting mechanism 46 is effectively spaced from the bottom section 23 and anchored to a bottom one 47 of the cylinders 24. The mechanism 46 further includes a plurality of deformably resilient helical springs 48 vertically oriented within the chamber 26 and positioned adjacent to an inner perimeter 49 of the cylinders 24 respectively. Of course, such springs 48 can be formed from a variety of suitable materials, as is obvious to a person of ordinary skill in the art.

Again referring to FIGS. 4 and 5, such selected ones of the springs 48 have a top end 51 directly anchored, without the use of intervening elements, to a bottom surface 52 of the pair 31 of bottom flange portions respectively. Such other ones of the springs 48 further have a bottom end 53 directly anchored, without the use of intervening elements, to corresponding ones of the pair 31 of bottom flanges. The springs 48 are compressed and decompressed when the middle section 22 is collapsed and extended respectively. The springs 48 effectively maintain the middle section 22 in a statically and vertically extended position during operating conditions, which is vital such that the apparatus 10 can effectively house the toothbrushes 12 contained therein during operating conditions.

Still again referring to FIGS. 4 and 5, each of the outer walls 41 and the sides 32 conveniently include a notch 54 formed therein and advantageously positioned above corresponding ones of the pair 31 of bottom flange portions, which is critical such that the top flange portions 29 effectively become interfitted with the notches 54 respectively. Such a relationship prevents the springs 48 from over extending the cylinders 24 during operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A collapsible toothbrush holder for effectively and hygienically storing a plurality of toothbrushes while traveling, said toothbrush holder comprising:

a resiliently squeezable body having telescopically conjoined top, middle, and bottom sections respectively, said middle section including a plurality of concentrically formed hollow cylinders interfitted within each other and connected to said top and bottom sections respectively, said cylinders being telescopically extendable along a centrally registered vertical axis passing through said body and having a vertical wall oriented thereabout, said top, middle and bottom sections forming a collapsible hollow chamber therein for housing corresponding handles of the toothbrushes, wherein said hollow chamber expands downwardly along the vertical axis;

said top section having an annular bottom end directly connected to an upper end of said middle section, said top section further having a planar top surface provided with a plurality of apertures formed therein such that the handles of the toothbrushes vertically penetrate through said apertures and contiguously lay within said chamber, said apertures being equidistantly spaced from each other and oriented concentrically about the vertical axis such that the tooth brushes maintain fixed spatial relationships during stored conditions, said top section including an outer wall monolithically formed with said bottom end and said top surface respectively, said bottom section having an annular shape threadably mated to a lower end of said middle section, said bottom section being provided with a plurality of apertures formed therein such that fluid drains from the toothbrushes housed within said chamber and penetrates outwardly from said body, said apertures radially extending outwardly from a center of said bottom section; and means for telescopically adjusting said top and middle sections in such a manner that said bottom section remains stationary as a longitudinal length of said chamber is adjusted, said telescopic adjusting means being spaced from said bottom section and anchored to a bottom one of said cylinders;

wherein each of said cylinders comprises:

a top flange portion and a pair of bottom flange portions monolithically formed with a vertically registered side of said cylinder, each of said top and pair of bottom flange portions being registered orthogonal to said side, said top flange portion and one of said pair of bottom flange portions extending inwardly toward said vertical axis, another of said pair of bottom flange portions extending outwardly from said side and oppositely faced from said one bottom flange portion, said another bottom flange portion having a top shoulder seated directly below said top flange portion and terminating at said side of said bottom cylinder such that said bottom cylinder is prohibited from vertically displacing beyond said top shoulder.

2. The toothbrush holder of claim 1, wherein said cylinders have decreasing diameters such that a top one of said cylinders are slidably positional within an adjacently disposed lower one of said cylinders when said middle section is collapsed.

3. The toothbrush holder of claim 1, wherein said telescopically adjusting means further comprises:

a plurality of deformably resilient helical springs vertically oriented within said chamber and positioned adjacent to an inner perimeter of said cylinders respectively, selected ones of said springs having a top end directly anchored to a bottom surface of said pair of bottom flange portions respectively, other ones of said springs further having a bottom end directly anchored to corresponding ones of said pair of bottom flanges, said springs being compressed and decompressed when said middle section is collapsed and extended respectively, said springs maintaining said middle section in a statically and vertically extended position during operating conditions.

4. The toothbrush holder of claim 1, wherein said outer wall further includes a flange portion monolithically formed with said bottom end thereof and directly engaged with an associated one of said top flange portions.

5. The toothbrush holder of claim 1, wherein each of said outer walls and said sides include a notch formed therein and positioned above corresponding ones of said pair of bottom flange portions such that said top flange portions becomes interfitted with said notches respectively.

6. A collapsible toothbrush holder for effectively and hygienically storing a plurality of toothbrushes while traveling, said toothbrush holder comprising:

a resiliently squeezable body having telescopically conjoined top, middle, and bottom sections respectively, said middle section including a plurality of concentrically formed hollow cylinders interfitted within each other and connected to said top and bottom sections respectively, said cylinders being telescopically extendable along a centrally registered vertical axis passing through said body and having a vertical wall oriented thereabout, said top, middle and bottom sections forming a collapsible hollow chamber therein for housing corresponding handles of the toothbrushes, wherein said hollow chamber expands downwardly along the vertical axis;

said top section having an annular bottom end directly connected to an upper end of said middle section, said top section further having a planar top surface provided with a plurality of apertures formed therein such that the handles of the toothbrushes vertically penetrate through said apertures and contiguously lay within said chamber, said apertures being equidistantly spaced from each other and oriented concentrically about the vertical axis such that the tooth brushes maintain fixed spatial relationships during stored conditions, said top section including an outer wall monolithically formed with said bottom end and said top surface respectively, wherein said top section is statically coupled directly to said middle section when said bottom section is selectively removed from said middle section;

said bottom section having an annular shape threadably mated to a lower end of said middle section, said bottom section being provided with a plurality of apertures formed therein such that fluid drains from the toothbrushes housed within said chamber and penetrates outwardly from said body, said apertures radially extending outwardly from a center of said bottom section; and means for telescopically adjusting said top and middle sections in such a manner that said bottom section remains stationary as a longitudinal length of said chamber is adjusted, said telescopic adjusting means being spaced from said bottom section and anchored to a bottom one of said cylinders;

wherein each of said cylinders comprises:

a top flange portion and a pair of bottom flange portions monolithically formed with a vertically registered side of said cylinder, each of said top and pair of bottom flange portions being registered orthogonal to said side, said top flange portion and one of said pair of bottom flange portions extending inwardly toward said vertical axis, another of said pair of bottom flange portions extending outwardly from said side and oppositely faced from said one bottom flange portion, said another bottom flange portion having a top shoulder seated directly below said top flange portion and terminating at said side of said bottom cylinder such that said bottom cylinder is prohibited from vertically displacing beyond said top shoulder.

7. The toothbrush holder of claim 6 wherein said cylinders have decreasing diameters such that a top one of said cylinders are slidably positional within an adjacently disposed lower one of said cylinders when said middle section is collapsed.

8. The toothbrush holder of claim 6 wherein said telescopically adjusting means further comprises:

a plurality of deformably resilient helical springs vertically oriented within said chamber and positioned adjacent to an inner perimeter of said cylinders respectively, selected ones of said springs having a top end directly anchored to a bottom surface of said pair of bottom flange portions respectively, other ones of said springs further having a bottom end directly anchored to corresponding ones of said pair of bottom flanges, said springs being compressed and decompressed when said middle section is collapsed and extended respectively, said springs maintaining said middle section in a statically and vertically extended position during operating conditions.

9. The toothbrush holder of claim 6 wherein said outer wall further includes a flange portion monolithically formed with said bottom end thereof and directly engaged with an associated one of said top flange portions.

10. The toothbrush holder of claim 6 wherein each of said outer walls and said sides include a notch formed therein and positioned above corresponding ones of said pair of bottom flange portions such that said top flange portions becomes interfitted with said notches respectively.

11. A collapsible toothbrush holder for effectively and hygienically storing a plurality of toothbrushes while traveling, said toothbrush holder comprising:

a resiliently squeezable body having telescopically conjoined top, middle, and bottom sections respectively, said middle section including a plurality of concentrically formed hollow cylinders interfitted within each other and connected to said top and bottom sections respectively, said cylinders being telescopically extendable along a centrally registered vertical axis passing through said body and having a vertical wall oriented thereabout, said top, middle and bottom sections forming a collapsible hollow chamber therein for housing corresponding handles of the toothbrushes, wherein said hollow chamber expands downwardly along the vertical axis;

said top section having an annular bottom end directly connected to an upper end of said middle section, said top section further having a planar top surface provided with a plurality of apertures formed therein such that the handles of the toothbrushes vertically penetrate through said apertures and contiguously lay within said chamber, said apertures being equidistantly spaced from each other and oriented concentrically about the vertical axis such that the tooth brushes maintain fixed spatial relationships during stored conditions, said top section including an outer wall monolithically formed with said bottom end and said top surface respectively, wherein said top section is statically coupled directly to said middle section when said bottom section is selectively removed from said middle section;

said bottom section having an annular shape threadably mated to a lower end of said middle section, said bottom section being provided with a plurality of apertures formed therein such that fluid drains from the toothbrushes housed within said chamber and penetrates outwardly from said body, said apertures radially extending outwardly from a center of said bottom section, wherein said bottom section has a diameter greater than a diameter of said lower end of said middle section such that said bottom section provides a stable platform during operating conditions; and means for telescopically adjusting said top and middle sections in such a manner that said bottom section remains stationary as a longitudinal length of said chamber is adjusted, said telescopic adjusting means being spaced from said bottom section and anchored to a bottom one of said cylinders;

wherein each of said cylinders comprises:

a top flange portion and a pair of bottom flange portions monolithically formed with a vertically registered side of said cylinder, each of said top and pair of bottom flange portions being registered orthogonal to said side, said top flange portion and one of said pair of bottom flange portions extending inwardly toward said vertical axis, another of said pair of bottom flange portions extending outwardly from said side and oppositely faced from said one bottom flange portion, said another bottom flange portion having a top shoulder seated directly below said top flange portion and terminating at said side of said bottom cylinder such that said bottom cylinder is prohibited from vertically displacing beyond said top shoulder.

12. The toothbrush holder of claim 11, wherein said cylinders have decreasing diameters such that a top one of said cylinders are slidably positional within an adjacently disposed lower one of said cylinders when said middle section is collapsed.

13. The toothbrush holder of claim 11, wherein said telescopically adjusting means further comprises:

a plurality of deformably resilient helical springs vertically oriented within said chamber and positioned adjacent to an inner perimeter of said cylinders respectively, selected ones of said springs having a top end directly anchored to a bottom surface of said pair of bottom flange portions respectively, other ones of said springs further having a bottom end directly anchored to corresponding ones of said pair of bottom flanges, said springs being compressed and decompressed when said middle section is collapsed and extended respectively, said springs maintaining said middle section in a statically and vertically extended position during operating conditions.

14. The toothbrush holder of claim 11, wherein said outer wall further includes a flange portion monolithically formed with said bottom end thereof and directly engaged with an associated one of said top flange portions.

15. The toothbrush holder of claim 11, wherein each of said outer walls and said sides include a notch formed therein and positioned above corresponding ones of said pair of bottom flange portions such that said top flange portions becomes interfitted with said notches respectively.

* * * * *